United States Patent [19]

Perri et al.

[11] 3,997,421

[45] Dec. 14, 1976

[54] TOP-MOUNTED ANODE SPACER CLIP

[75] Inventors: Roland Perri, Trail; Leonard J. Heinrick, Montrose, both of Canada

[73] Assignee: Cominco Ltd., Vancouver, Canada

[22] Filed: Feb. 2, 1976

[21] Appl. No.: 655,021

[52] U.S. Cl. ..... 204/267; 204/286; 204/297 R

[51] Int. Cl.[2] ..... C25C 7/00

[58] Field of Search ..... 204/267, 286, 288, 297 R, 204/297 W

[56] References Cited

UNITED STATES PATENTS

| | | | |
|---|---|---|---|
| 3,477,939 | 11/1969 | Kircher | 204/268 |
| 3,701,726 | 10/1972 | Labouc | 204/297 R |
| 3,875,040 | 4/1975 | Weltin et al. | 204/267 |

FOREIGN PATENTS OR APPLICATIONS

| | | | |
|---|---|---|---|
| 822,092 | 9/1969 | Canada | 204/267 |
| 903,038 | 9/1945 | France | 204/297 R |

*Primary Examiner*—F.C. Edmundson
*Attorney, Agent, or Firm*—Arne I. Fors

[57] ABSTRACT

An improved spacer clip for mounting on an anode header bar joined to and supporting a planar anode sheet in an electrolytic cell containing a plurality of anodes and cathodes provides improved protection against direct anode-to-cathode contact and maintenance of more uniform spacing between adjacent anodes and cathodes. The spacer clip, formed of a resilient electrically non-conducting material such as medium density polypropylene, comprises a central body defining a vertex, a pair of arms extending from the vertex adapted to fit over the header bar, and a pair of exterior wings depending from the arms and diverging to a maximum spacing coextensive with the ends of the arms and thence converging towards each other to terminate in ends substantially tangential to the supported anode sheet.

18 Claims, 2 Drawing Figures

TOP-MOUNTED ANODE SPACER CLIP

BACKGROUND OF THE INVENTION

This invention relates to an improved spacer clip and is particularly directed to a non-conducting spacer clip adapted for mounting on header bars of anodes used in electrolytic cells. Spacer clips of the invention provide uniform electrode positioning and spacing and improved protection against direct anode-to-cathode contact during placement of the cathodes and operation of the electrolytic cells.

In hydroelectrometallurgy, the electrodeposition of metals from electrolytes onto cathode starting sheets necessitates the positioning of anodes which are not consumed in the process on each side of the cathodes substantially coextensive with the cathodes. Touching of adjacent cathodes and anodes is a serious problem in the process and various means have been developed for separating and maintaining separate the anodes and cathodes from each other to prevent losses in current efficiency due to short-circuiting. For example, electrode header bars for suspending the cathodes and anodes in a spaced relationship, such as by notched supports, are commonly used and are effective for maintaining separation of the upper parts of the vertically disposed electrode plates. However, if the header bars are not rigidly attached to bus bars, the lower parts of the electrodes are free to move laterally and, unless this movement is restrained by the use of ancillary spacers, irregular deposition of metal with eventual short-circuiting, or even immediate short circuiting, may occur. In processes requiring frequent removal of cathodes from the electrolytic cells, rigid attachment of the header bars of these cathodes to bus bars necessitates considerable repetitive labour and impeded productivity and is thus preferably avoided. Anodes may be rigidly attached to the bus bars or may be suspended freely.

The framing of electrode plates with insulating material sufficiently thick to prevent electrical contact of adjacent anodes and cathodes, particularly with accumulated deposits of metal on the cathodes, has proven impracticable and uneconomic. The frames on the anodes tend to snag cathodes that are being immersed into or removed from the electrolyte. Also, such frames render ineffective much of the area of the electrodes. Guide strips have been set in cell side walls, but these also render considerable electrode area ineffective, require costly tank construction, and interfere with free circulation of electrolyte.

The attachment of small insulators directly to electrodes is well known. For example, the use of porcelain or plastic buttons inserted in the lower part of the anode, which is generally removed from the electrolyte less frequently than the cathode, is known. In that the buttons are small in size, the buttons advantageously render inactive only a small part of electrode surface but, due to frequent breakages, particularly during placement and removal of cathode sheets, frequent shutdowns have proven necessary for correcting short-circuiting.

U.S. Pat. No. 2,868,711 discloses the separation of the lower parts of anodes and cathodes by the placement of horizontal insulating rods supported loosely at their ends in structures attached to cells such that the weight of the rods presses the anodes into desired vertical alignment while permitting limited lateral movement of the anodes. Insertion of the horizontal rods through openings in the tank side walls can only be carried out when the electrolyte has been removed from the cell and, accordingly, this technique is not compatible with continuous process in which the tanks remain filled with electrolyte.

U.S. Pat. No. 2,872,406 discloses the separation of adjacent electrodes by the use of a rectangular frame made of styrene acrylonitrile copolymer to encase each anode by rigid vertical rods on each side of the anode. This apparatus serves functions other than the separation of anodes and adjacent cathodes and has proven too complex for continuous cathodic deposition of metals from electrolytes. In addition, this apparatus considerably reduces effective electrode surface area.

U.S. Pat. No. 2,995,507 teaches the use of vertically suspended helical strips of plastic with upper and lower ends connected to rigid bars suspended loosely between anodes and cathodes. These structures are non-conductors of electricity and are made of material with a specific gravity slightly greater than that of the electrolyte. This arrangement provides good utilization of electrolyte space and electrode area but serious disadvantages are complexity of design and difficulty in placement of cathodes between adjacent anodes.

Co-pending Canadian Pat. application No. 127,301 discloses a spacer clip which substantially overcomes the foregoing disadvantages of known electrode spacers. The spacer clip disclosed is adapted for attachment to the bottom of a vertically suspended anode sheet and comprises a wedge having a pair of opposed, spaced apart wings extending from each face of the wedge with outer faces initially diverging from the apex of the wedge and thence converging towards each other, whereby said wings can be flexed towards and away from each other. Longitudinal recesses are formed on opposite sides of the wedge for engagement with opposed edges of a slot in the anode sheet. In an electrolytic cell assembly comprising an arrangement of alternating suspended anodes and cathodes, each anode has at least one elongated vertical slot formed in its bottom edge. When a spacer clip is inserted in this slot, the wings of the spacer clip as described maintain substantially equal and parallel spacing of the lower ends of the anode and adjacent cathodes. Spacing of the upper ends of the electrodes may be maintained by known means such as the resting of the ends of supporting header bars in notches in bus bars and insulators. Such fixed, upper end spacing with bottom-mounted spacer clips generally provides effective separation of anodes and cathodes to eliminate short-circuiting in situ and to prevent losses in current efficiency.

In processes such as the electrolytic deposition of zinc on aluminum cathodes, the cathodes are cyclically removed from the electrolytic cells for separation of zinc and returned to the cells. It is customary to remove a portion of the cathodes from a cell without interrupting electrodeposition on the remaining cathodes in the cell. If removal and replacement of cathode sheets is carried out carefully, no difficulties will arise. However, during the raising or lowering of a set of cathodes, accidental swaying may occur, causing one or more cathodes to touch one or more anode header bars. The resulting short circuit damages the anode, even to the extent of burning off the header bar. Also, during the lowering of a set of cathodes, the entry of each cathode between a pair of anodes must be carefully guided to avoid contacts which damage electrode surfaces and which cause short-circuiting.

STATEMENT OF INVENTION

We have found that top mounted insulators of the present invention in the form of spacer clips mounted on the anode header bars protect stationary anodes against electrical contact by cathodes as the cathodes are being withdrawn from or placed into the cells and also provide cushioning against possible impacts that may damage electrode surfaces.

Header bar mounted anode spacer clips provide improved electrode-to-electrode spacing where poor cell geometry exists as in the case of older cells in which continued use has resulted in misalignment of bus bar notches with insulator notches and with the cells themselves. With good cell geometry, plus fixed, uniform intervals between the anodes, correct placement of one cathode in relationship to adjacent anodes will assure correct placement of all the electrodes in the cell if fixed intervals between the cathodes equal those between the anodes. However, with use of such fixed, uniform intervals, cell irregularities may cause misalignment of certain adjacent electrodes. Under these conditions header bar mounted anode spacer clips having flexible spacing means will resiliently urge each cathode to a more central position between adjacent anodes. Easy yielding of flexible spacing wings of each clip towards the anode, when pressed by thick zinc deposits as cathodes are being raised out of the cells, precludes snagging of the zinc on the clip and resultant tendency to lift the anode.

A fixed spatial relationship at one end of a set of header bars together with one anode spacer clip mounted on each header bar towards the other end may be used. We have found a spaced placement of two clips on each header bar to be more effective. Preferably, complete control of electrode spacing is assured by the simultaneous use of two bottom mounted anode spacer clips, according to the invention disclosed in Canadian Pat. Application No. 127,301 and hereinwith briefly described.

It is an object of the present invention to provide an assembly of suspended anodes in an electrolytic cell with header bar mounted insulating spacer clips to eliminate short-circuiting due to excessive lateral movement of cathodes during their placement into or removal from the cell.

It is another object of the invention to provide an assembly of suspended anodes and cathodes in an electrolytic cell in which misalignment from an intended parallel arrangement due to cell irregularities may, at least in part, be overcome by providing more uniform electrode-to-electrode spacing with electrically non-conducting spacer clips attached to the anode header bars.

It is a further object of the invention to provide a plastic spacer clip comprising parts with an elastic structure which permits clipping onto an anode header bar and which provides resilient resistance to lateral pressure that may be exerted by a cathode adjacent to an anode on which the clip may be mounted.

BRIEF DESCRIPTION OF THE DRAWING

These and other objects of the invention, and the manner in which they can be obtained, will become apparent from the following detailed description of the drawing, in which.

Like character references refer to like parts throughout the description of the drawing.

DESCRIPTION OF THE PREFERRED EMBODIMENT

Figure 1:
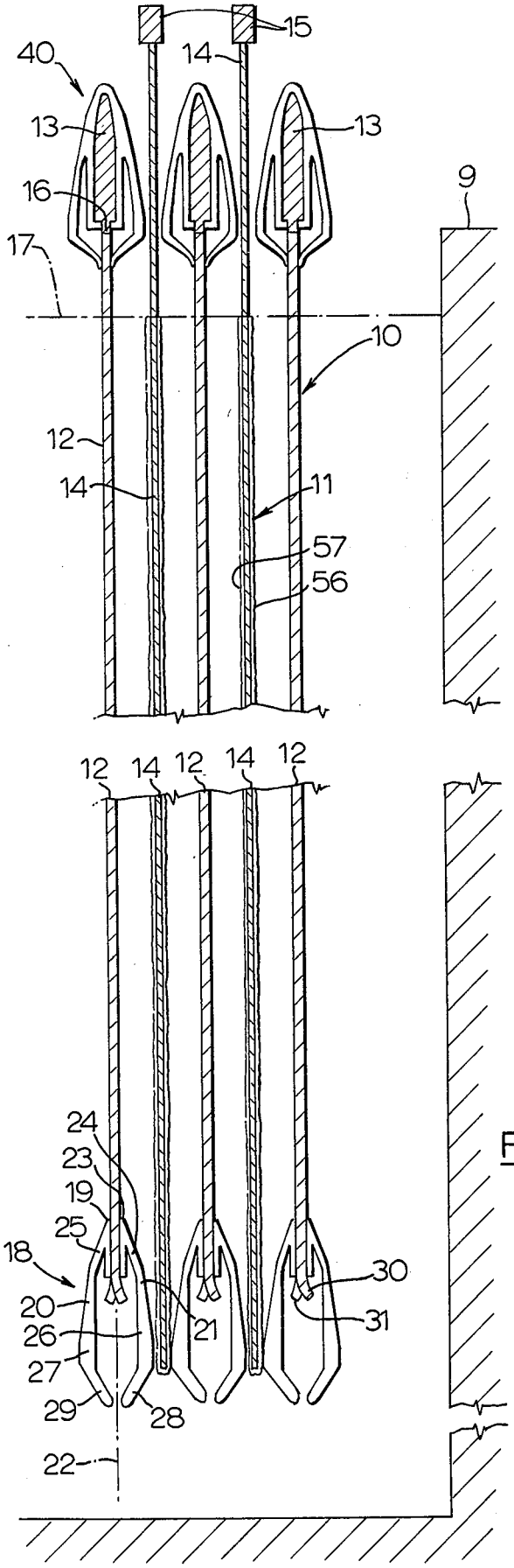
FIG. 1 is a vertical section of an assembly of suspended anodes and cathodes in an electrolytic cell having spacer clips of the present invention secured to anode header bars and spacer clips of Canadian Pat. No. 970,718 secured to the bottoms of the anodes.

There is shown in FIG. 1 a plurality of alternate anodes 10 and cathodes 11. Each anode 10 comprises a planar anode sheet 12 attached to a header bar 13, while each cathode comprises a planar cathode sheet 14 attached to a header bar 15. Planar sheets 12 and 14 are suspended in a substantially parallel, equally spaced relationship from elongated header bars 13 and 15 respectively in an electrolytic cell designated by numeral 9. Each of header bars 13, formed of cast lead, is welded to the upper edge of a planar lead alloy sheet portion 12 to form a juncture along line 16. Cathode header bars 15 are supported at a level above that of anode header bars 13, which are positioned above solution line 17, to facilitate withdrawal from and insertion of cathodes 11 into the cell. Also, each planar anode sheet 12 has an elongated slot in its bottom edge perpendicular thereto for receiving spacer clip designated generally by the numeral 18. Corners 30 and 31 of this elongated slot are shown in FIG. 1 in a deformed position to lock clip 18 in its mounted position.

As described in more detail in Canadian Pat. Application No. 127,301, bottom mounted spacer clip 18 comprises a wedge 19 having a pair of opposed wings 20, 21 extending therefrom, said wings 20, 21 having outer surfaces diverging along longitudinal axis 22 away from the wedge apex 23. Each wing 20, 21 has an initially thin portion 24, 25 to provide flexibility thereto and a thickened portion 26, 27 to continue the divergence of the wing outer face. Wing extremities 28, 29 converge along axis 22 to form a symmetrical polygon or a convexly faced structure. Longitudinal recesses (not shown) are formed on each side of wedge 19 to engage the opposed edges of the anode slot having corners 30 and 31. Lower clip 18 is attached to the bottom of the anode by moving it upwardly so that its longitudinal recesses engage the opposed edges of the anode slot with corners 30, 31 projecting beyond wedge 19, and then deforming corners 30, 31 to hold the clip in place.

Figure 2:
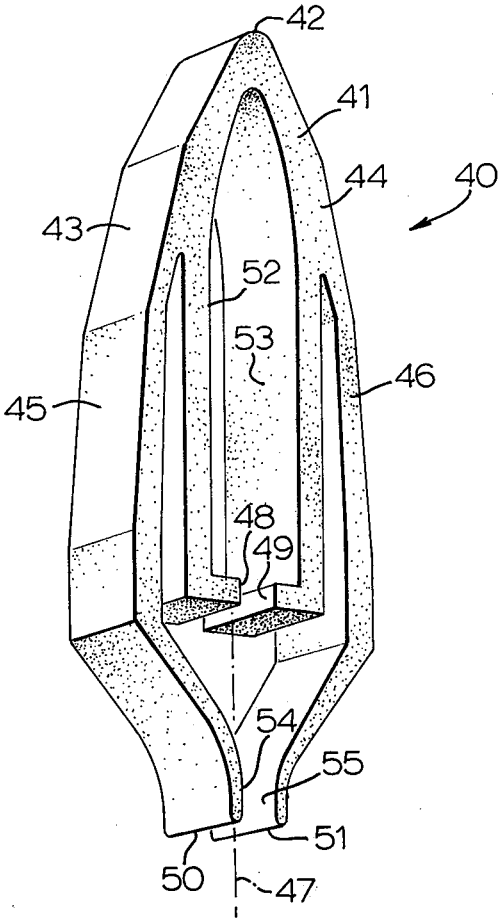
FIG. 2 is an enlarged section of the spacer clip of the present invention shown in FIG. 1.

Anode spacer clip 40 of the present invention, shown more clearly in FIG. 2, comprises a central portion 41 forming vertex 42, header bar engaging arms 43, 44 and exterior depending wings 45, 46, all initially symmetrically diverging away from longitudinal clip axis 47 and thence converging at their opposite free ends to form end faces 48, 49 and opposed ends 50, 51, respectively. Inner faces 52, 53 of arms 43, 44 are dimensioned to fit snugly over a length of header bar 13, said header bar having a substantially uniform cross section throughout its length, while faces 48, 49 are adapted to abut the surfaces of that portion of the header bar 13 which is welded onto planar sheet portion 12, i.e. in proximity to the juncture 16 of the header bar and the planar anode sheet. Arms 43, 44 are sufficiently elastic to yield without breaking as the gap between faces 48 and 49 is opened wide enough to permit passage of the spacer clip over header bar 13 for the engagement of inner faces 52, 53 therewith. With this engagement, substantially parallel end faces 48, 49 are spaced from each other a distance substantially equal to the thickness of the header bar at juncture 16, i.e., each face is spaced from the longitudinal axis of the clip a distance substantially equal to one half the thickness of the anode sheet.

Attached wings 45, 46 depending from arms 43, 44 diverge to a maximum spacing from longitudinal axis 47 at a distance from vertex 42 which is about equal to the distance of faces 48, 49 from the vertex, and then converge sharply with opposed faces 54, 55 adjacent ends 50, 51, flexibly spaced to tangentially approach the opposite surfaces of anode sheet 12 beyond the juncture of the header bar and the anode sheet when the clip is mounted on the header bar, i.e. each face 54, 55 is spaced from the longitudinal axis of the clip a distance substantially equal to one half the thickness of the anode sheet. Ends 50, 51 are rounded to permit smooth gliding of faces 54, 55 on anode planar portions 12 when lateral pressure is exerted on wings 45, 46. Flexible wings 45, 46 diverge sufficiently from axis 47 to provide, when mounted to coact between adjacent anodes, resilient urging of cathode sheets 14 into positions equidistant from adjacent anode sheets 12. Wings 45, 46 also yield laterally as cathode sheets 14 bearing zinc deposits 56, 57 are removed from the electrolytic cell. Thick zinc deposits on the cathodes, including irregular peanut growths, glide past these top mounted spacer clips. Snagging which would occur with more rigid clips, with a resulting tendency to lift the anodes, is avoided.

When mounted on header bars 13 of anodes 10 in situ, spacer clips 40 are entirely above cell solution line 17 and do not require the same degree of acid resistance as the submerged bottom mounted anode spacer clips. A medium density polypropylene provides both the strength and flexibility required to permit yielding without breaking when a clip is struck by moving cathodes. Acid resistant acrylonitrile-butadiene-styrene polymer is preferred for submerged bottom mounted clips.

A clip 6½ inches in length and 1 inch deep having a maximum width of 2½ inches was manufactured for use with ¼ inch thick planar sheet anodes and a 4 inch high header bar having maximum thickness of ⅞ inch. The clip was ⅜ inch thick at the vertex where the outer and inner faces were rounded on 3/16 inch and ⅛ inch circles respectively. Between the vertex and the points of attachment of the wings, the arms had a minimum thickness of 5/16 inch, while the remaining portions of the arms which were adapted to engage the header bar had a minimum thickness of ¼ inch. Opposed faces 48, 49, located about 5 inches from the apex, were parallel to clip axis 47 and were ⅛ inch apart. The electrode spacing wings were about ⅛ inch thick near the areas of attachment to the arms, and were tapered to a thickness of about ¼ inch at their maximum spacing coextensive with faces 48, 49 measured from the vertex. The portions of the wings converging towards ends 50, 51 were tapered to 3/32 inch and were convexly curved on their interior faces 54, 55 to be parallel as the faces approached clip axis 47.

The header bar mounted spacer clip of the present invention is used preferably in conjunction with the bottom mounted spacer clip disclosed in Canadian Pat. application No. 127,301. The best arrangement is provided by two spaced-apart bottom mounted clips and two spaced-apart header bar mounted clips on each anode of a plurality of alternate anodes and cathodes suspended in a parallel spaced relationship in an electrolytic cell.

It will be understood, of course, that other modifications can be made in the preferred embodiment of the present invention as described hereinabove without departing from the scope and purview of the appended claims.

The embodiments of the invention in which an exclusive property or privilege is claimed, are defined as follows:

1. A spacer clip for securement to an elongated anode header bar joined to and supporting a planar anode sheet in an electrolytic cell containing a plurality of anodes and cathodes comprising: a central body portion defining a vertex, a pair of arms diverging from the vertex and adapted to fit snugly over a length of the said header bar with said arms converging at their free ends in proximity to the juncture of the header bar and anode sheet, a pair of symmetrically diverging exterior wings depending from the arms having a maximum spacing from each other substantially coextensive with the ends of the said arms and thence converging towards each other beyond the free ends of said arms, said arms being sufficiently elastic to permit separation of their ends for placement over the header bar, and said wings being sufficiently elastic to resiliently resist lateral pressures from adjacent cathode sheets.

2. A spacer clip as claimed in claim 1 in which said arms and said wings are symmetrically formed about the longitudinal axis of the clip.

3. A spacer clip as claimed in claim 2 in which the wings have initially thin diverging portions in proximity to the arms to provide flexibility thereto.

4. A spacer clip as claimed in claim 3 in which, on securement of the clip to a header bar, said arms converge at their free ends in proximity to the juncture of the header bar and the planar anode sheet to abut the opposite surfaces of the header bar.

5. A spacer clip as claimed in claim 3 in which said arms converge at their free ends to form substantially parallel end faces spaced from each other a distance substantially equal to the thickness of the header bar at the juncture of the header bar and the anode sheet.

6. A spacer clip as claimed in claim 3 in which the converging portions of the exterior wings terminate in spaced-apart rounded ends which are, on securement of the clip to a header bar, tangentially disposed to the anode sheet.

7. A spacer clip as claimed in claim 3 in which the converging portions of the exterior wings terminate in rounded ends having adjacent opposed faces each flexibly spaced from the longitudinal axis of the clip a distance substantially equal to one half the thickness of the anode sheet.

8. A spacer clip as claimed in claim 3 in which said arms converge at their free ends to form substantially parallel end faces spaced from each other a distance substantially equal to the thickness of the header bar at the juncture of the header bar and the anode sheet and in which the converging portions of the exterior wings terminate in rounded ends having adjacent opposed faces each flexibly spaced from the longitudinal axis of the clip a distance substantially equal to one half the thickness of the anode sheet.

9. A spacer clip as claimed in claim 8 in which said clip is formed of an electrically non-conducting material having the characteristics of medium density polypropylene.

10. An electrolytic cell with a plurality of alternate anodes and cathodes contained therein, said anodes and cathodes comprising planar sheets attached to and suspended from elongated header bars in substantially parallel spaced relationship, each anode having at least one lower spacer clip secured to the bottom edge thereof and at least one upper spacer clip secured to the anode header bar, said upper spacer clip comprising: a central body portion defining a vertex, a pair of arms diverging from the vertex and adapted to fit snugly over a length of the said header bar with said arms converging at their free ends in proximity to the juncture of the header bar and anode sheet, a pair of symmetrically diverging exterior wings depending from the arms having a maximum spacing from each other substantially coextensive with the ends of the said arms and thence converging towards each other beyond the free ends of said arms, said arms being sufficiently elastic to permit separation of their ends for placement over the header bar, and said wings being sufficiently elastic to resiliently resist lateral pressures from adjacent cathode sheets.

11. A spacer clip as claimed in claim 10 in which said arms and said wings are symmetrically formed about the longitudinal axis of the clip.

12. A spacer clip as claimed in claim 11 in which the wings have initially thin diverging portions in proximity to the arms to provide flexibility thereto.

13. A spacer clip as claimed in claim 12 in which, on securement of the clip to a header bar, said arms converge at their free ends in proximity to the juncture of the header bar and the planar anode sheet to abut the opposite surfaces of the header bar.

14. A spacer clip as claimed in claim 12 in which said arms converge at their free ends to form substantially parallel end faces spaced from each other a distance substantially equal to the thickness of the header bar at the juncture of the header bar and the anode sheet.

15. A spacer clip as claimed in claim 12 in which the converging portions of the exterior wings terminate in spaced-apart rounded ends which are, on securement of the clip to a header bar, tangentially disposed to the anode sheet.

16. A spacer clip as claimed in claim 12 in which the converging portions of the exterior wings terminate in rounded ends having adjacent opposed faces each flexibly spaced from the longitudinal axis of the clip a distance substantially equal to one half the thickness of the anode sheet.

17. A spacer clip as claimed in claim 12 in which said arms converge at their free ends to form substantially parallel end faces spaced from each other a distance substantially equal to the thickness of the header bar at the juncture of the header bar and the anode sheet and in which the converging portions of the exterior wings terminate in rounded ends having adjacent opposed faces each flexibly spaced from the longitudinal axis of the clip a distance substantially equal to one half the thickness of the anode sheet.

18. A spacer clip as claimed in claim 17 in which said clip is formed of an electrically non-conducting material having the characteristics of medium density polypropylene.

* * * * *